US005351813A

United States Patent [19]

Golovan

[11] Patent Number: 5,351,813

[45] Date of Patent: Oct. 4, 1994

[54] DISPLAY AND STORAGE APPARATUS

[76] Inventor: Bruce Golovan, 23305 Beachwood Blvd., Beachwood, Ohio 44122

[21] Appl. No.: 130,153

[22] Filed: Sep. 30, 1993

Related U.S. Application Data

[63] Continuation of Ser. No. 801,671, Dec. 2, 1991, abandoned.

[51] Int. Cl.[5] ..... B65D 30/22

[52] U.S. Cl. ..... 206/45.34; 206/449; 206/466; 206/806; 206/818; 383/39; 383/40; 383/11; 383/106

[58] Field of Search ..... 206/449, 806, 818, 425, 206/466, 45.34; 150/113; 190/110; 383/38, 39, 40, 11, 106

[56] References Cited

U.S. PATENT DOCUMENTS

| | | | |
|---|---|---|---|
| 3,187,903 | 6/1965 | Oltz | 383/11 X |
| 3,722,564 | 3/1973 | Croon | 206/815 X |
| 3,908,824 | 9/1975 | Takahara et al. | 206/815 X |
| 4,234,086 | 11/1980 | Dorton | 383/106 X |
| 4,629,070 | 12/1986 | Roberg | 383/38 X |
| 4,642,934 | 2/1987 | Carlson et al. | 383/11 X |
| 4,859,084 | 8/1989 | Kaumeger | 383/39 |
| 4,953,765 | 9/1990 | Little et al. | 383/39 X |
| 4,970,821 | 11/1990 | Young | 150/113 X |
| 5,024,361 | 6/1991 | Flowers | 383/39 X |

*Primary Examiner*—Jacob K. Ackun, Jr.

*Attorney, Agent, or Firm*—Fay, Sharpe, Beall, Fagan, Minnich & McKee

[57] ABSTRACT

A holding apparatus for holding relatively small items comprised of a generally flexible planar base, attachment means for attaching the base to a vertical surface such as a refrigerator door or the like, at least one storage and/or display compartment, and at least one fastener for releasably attaching the compartments to the base. The holding and/or display apparatus allows a user to detach and carry along the detachable compartment to a desired destination. In addition, the apparatus may be utilized for organizing and/or visibly displaying relatively light weight and thin materials such as appointment cards, theatrical tickets, photographs, sketches, etc. without puncturing or affecting the integrity of the material.

16 Claims, 5 Drawing Sheets

DISPLAY AND STORAGE APPARATUS

This is a continuation of co-pending application Ser. No. 07/801,671 filed on Dec. 2, 1991, now abandoned.

BACKGROUND OF THE INVENTION

This invention relates to a device for displaying and/or holding relatively thin, lightweight objects, such as medical or dental appointment cards, photographs, sketches, coupons, post cards, theatrical tickets, shopping lists, calendars, etc. in a generally vertical manner, such as attached to a refrigerator door or the like. More particularly, the invention is directed to an apparatus having a base and releasably attached storage and/or display compartments of various sizes. The releasably attached compartments can be composed of transparent and/or non-transparent material and disposed in various configurations for attachment to a base surface that is disposed in a generally vertical plane.

While the invention is particularly directed to the art of accessory and/or display holders, and will be thus described with specific reference thereto, it will be appreciated that the invention may have usefulness in other fields and applications.

A wide variety of holding apparatus that are attachable to some type of vertical surface, such as a refrigerator door or the like, are known. However, those known lack a number of convenient features, such as detachable pockets or storage compartments. For instance, U.S. Pat. No. 4,736,853 to O'Mara discloses a flexible magnetized holder with pockets for accessories such as note pads, books, pens, tissues, or the like, which allows for convenient placement on and removal from ferromagnetic surfaces such as locker doors and refrigerator doors. The material forming the pockets of O'Mara, however, is generally opaque and is sewn or glued to the base. Consequently, the pockets are not detachable and/or transparent.

Likewise, U.S. Pat. No. 4,401,219 to Mink discloses a jewelry storage container including a generally planar flexible web shaped member on which is mounted a plurality of compartments. These compartments, however, are not detachable. The advantage of being able to detach the pocket, or storage compartment, is that a user can simply detach and carry along a whole pocket if he/she so desires. This obviates the need to remove any objects from the pocket, thus, reducing the risk of losing or destroying the objects. For example, a whole pocket of coupons can be conveniently detached and brought with the user to a retail store.

Additionally, detachable pockets allow the user to configure the various pockets on the holding and/or display apparatus in any convenient fashion, thereby providing for a wide variety of configurations. This provides the user of the holding and/or display apparatus with the flexibility to design and redesign the apparatus dependent upon individual tastes, storage and/or display needs.

SUMMARY OF THE INVENTION

An object of the present invention is to provide a holding apparatus for attachment to a surface disposed in a generally vertical plane and including storage and/or display compartments releasably attached thereto.

The above object is achieved in the present invention by providing a holding apparatus comprising a generally flexible planar base, base attachment means for attaching the base to a surface disposed in a generally vertical plane, storage and/or display compartments, and compartment attachment means for releasably attaching at least one of the storage and/or display compartments to the flexible planar base. The base and storage compartments can be formed of thin, flexible, lightweight transparent plastic, thereby permitting easy visibility of the storage and/or displayed objects.

In addition, the storage compartment attachment means can be comprised of a wide assortment of detachable fastening means such as one or more snap fastener mechanisms or one or more hook and loop fastening strips such as VELCRO® strips. As a result, the storage and/or display compartments can be easily attached to and detached from the base of the apparatus. The base attachment means includes any means for attaching the base to a vertical surface including the use of one or more magnetic strips.

Identical objects can also be achieved in a further embodiment of the invention. This embodiment of the invention provides that at least one of the storage compartments is fixedly attached to the base through heat sealing or other suitable means. Moreover, the apparatus provides for the storage and/or display of relatively small objects without puncturing and/or affecting the integrity of the object to be stored or displayed.

An additional object of this invention is to provide a vertical holding and/or display apparatus which allows for the convenient attachment and/or removal from vertical surfaces. Moreover, the apparatus will not mark or scratch the surface of the vertical plane to which it is attached.

A still further object of the invention is to provide a vertical holding and/or display device that is durable in use and refine in appearance. In addition, since the apparatus is comprised of a flexible material, the apparatus can be easily compacted for storage and travel.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DESCRIPTION OF THE DRAWINGS

The present invention consists in the construction, arrangement, and combination, of the various parts of the device, whereby the objects contemplated are attained as hereinafter more fully set forth, specifically pointed out in the claims, and illustrated in the accompanying drawings in which:

DETAILED DESCRIPTION OF THE PREFERRED EMBODIMENTS

Figure 1:
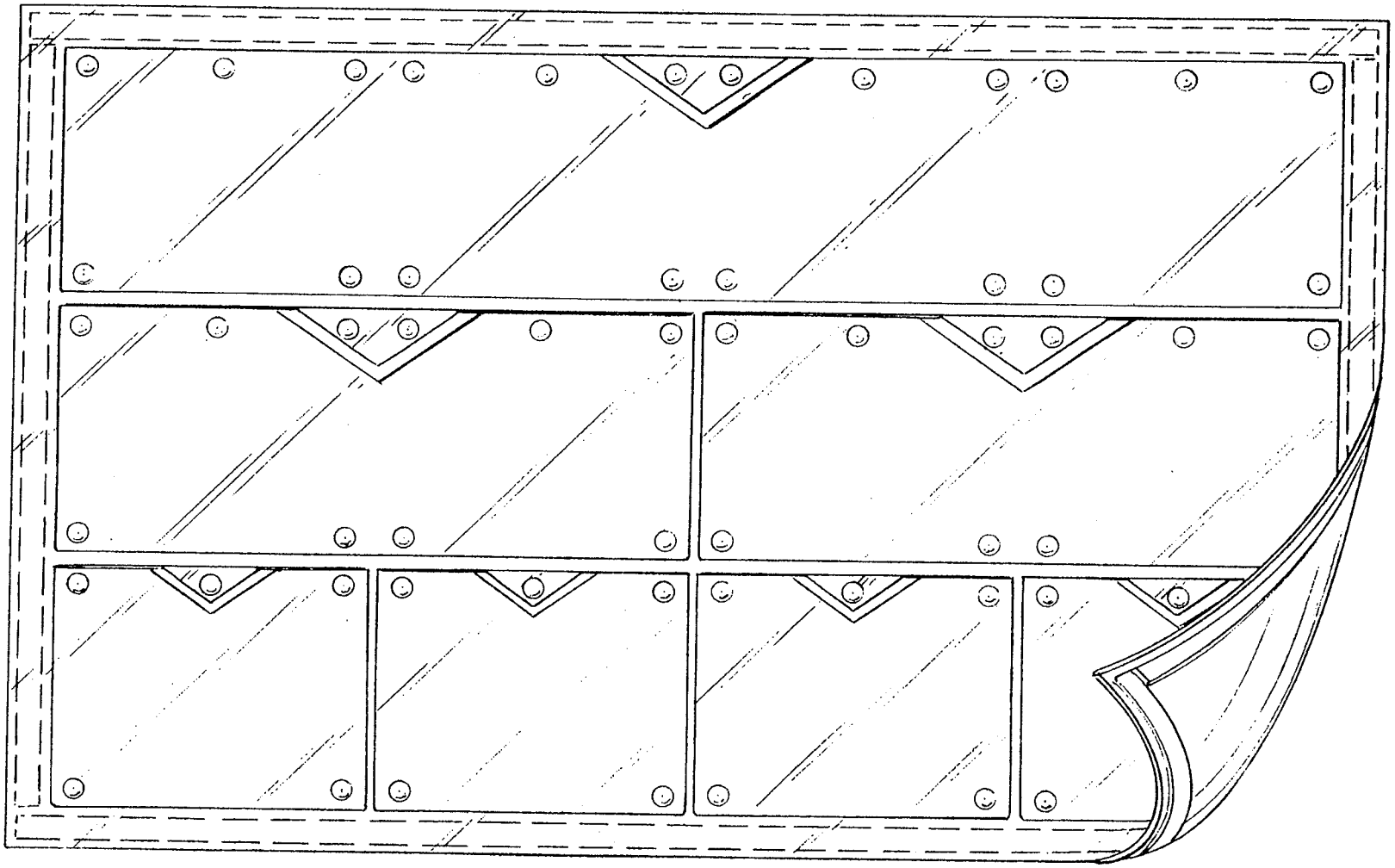
FIG. 1 is a front elevational view of one embodiment of the storage and/or display apparatus having detachable compartments herein contemplated.

Referring now to the drawings wherein the showings are for purposes of illustrating the preferred embodiments of the invention only and not for purposes of limiting same, FIG. 1 provides a view of the overall preferred embodiment. As shown, the holding apparatus 10 is comprised of a generally flexible planar base 12, at least one pocket or storage (and/or display) compartment 14, 31, 33, 35, 37, 39 and 41, at least one base attachment means 16, 17, 44 and 46 (shown in the front view in phantom) and at least one pocket or storage compartment attachment means 18. The pockets or storage (and/or display) compartments 14, 31, 33, 35, 37, 39 and 41 are detachably mounted on the flexible planar base 12. Since the pockets or storage compartments 14, 31, 33, 35, 37, 39 and 41 are substantially the same except for dimensional differences, the composition of all of the storage or display compartments will be described with reference to compartment 14.

Although the base 12 and the pocket 14 of the preferred embodiment of the invention are formed of a flexible, thin, lightweight, transparent plastic material which is suitable for heat bonding, it is appreciated by the inventor that alternative materials could suitably be used to achieve substantially the same result. For instance, opaque material could suitably be used without substantially altering the scope of the invention. Further, the pocket attachment means 18 of the preferred embodiment comprises a plurality of snap fasteners which will be described in greater detail with reference to FIGS. 2*a* through 4*c*. However, as it is understood by those skilled in the art, the pocket or compartment attachment means may be any detachable/attachable means that is of sufficient strength, size, configuration, etc. to provide the storage and/or display means contemplated by the present invention.

Base 12 is primarily comprised of a single, planar sheet of unitary construction. The size and/or shape of base 12 can be varied depending upon the configuration desired. Preferably, base 12 is substantially rectangular in shape, and is defined by a bottom edge 13, an upper edge 15 and side edges 48 and 50.

Figure 2A:
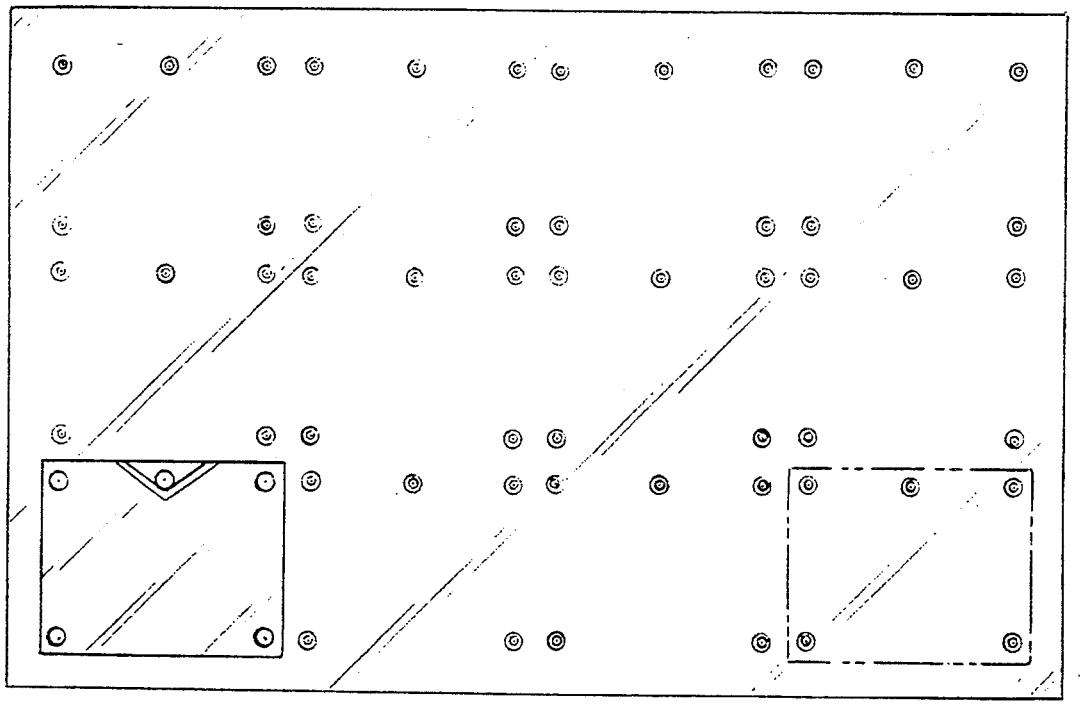
FIG. 2*a* is a front elevational view of the storage and/or display apparatus shown in FIG. 1 with all of the detachable compartments, except for one, being removed.
Figure 2B:
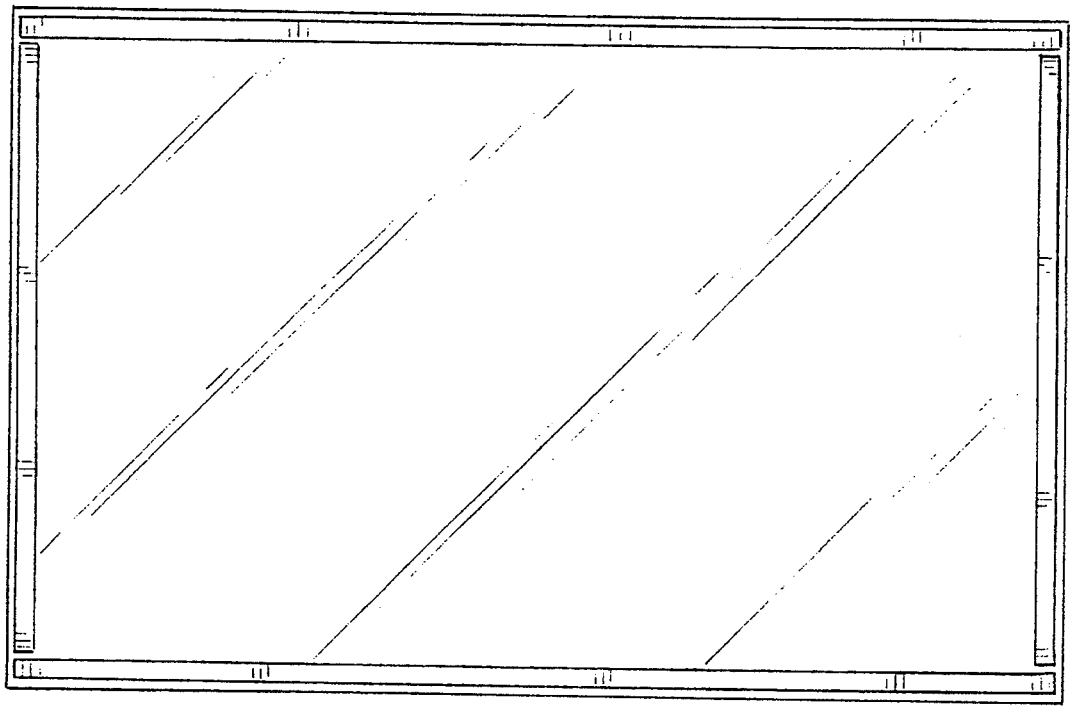
FIG. 2*b* is a rear elevational view of the storage and/or display apparatus shown in FIG. 1.
Figure 3A:
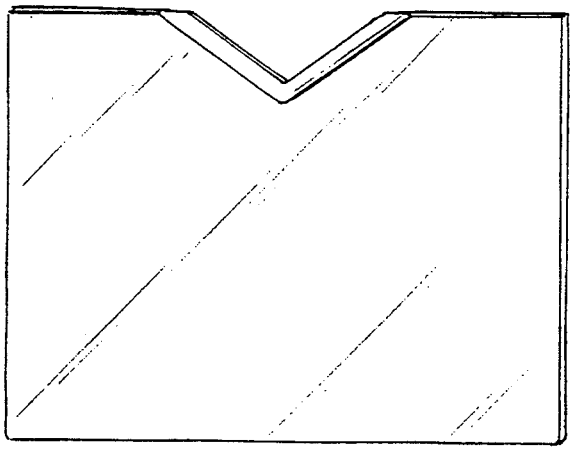
FIG. 3*a* is a front elevational view of the front portion of one of the detachable storage and/or display compartments shown in FIG. 1.
Figure 3B:
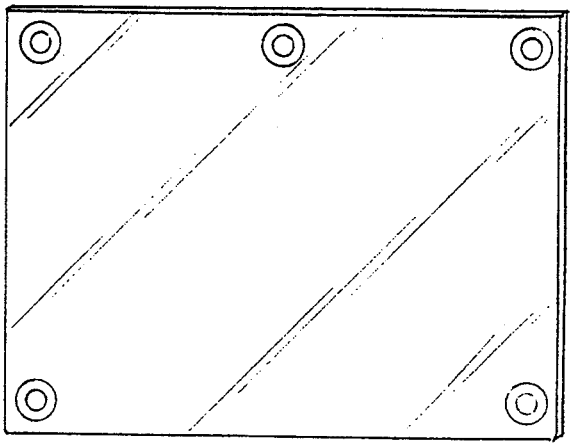
FIG. 3*b* is a rear elevational view of one of the back portions of the detachable storage and/or display compartments shown in FIG. 1.
Figure 3C:
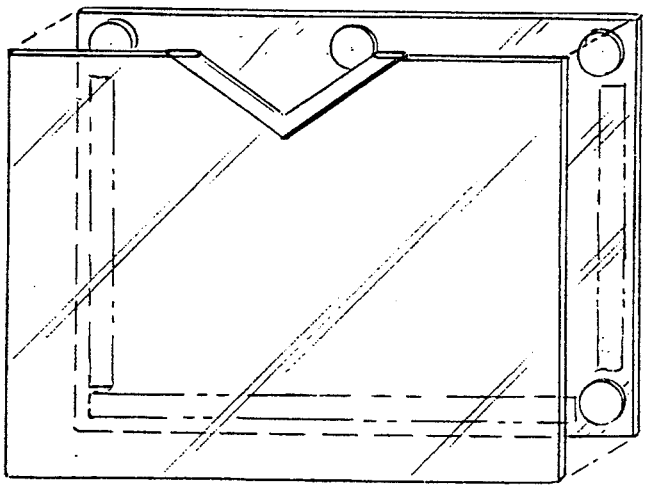
FIG. 3*c* is an exploded front elevational view of one of the detachable storage and/or display compartments shown in FIG. 1.
Figure 4A:
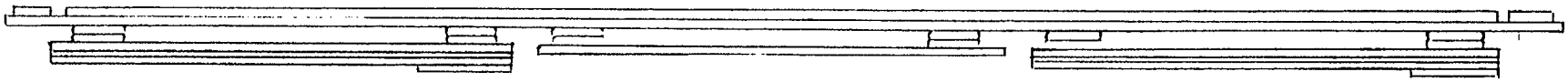
FIG. 4*a* is a side elevational view of the storage and/or display apparatus substantially shown in FIG. 1 including one modified storage and/or display compartment.
Figure 4B:
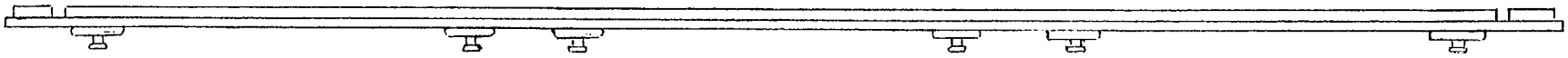
FIG. 4*b* is a side elevational view of the storage and/or display apparatus shown in FIG. 1 having its detachable compartments detached.
Figure 4C:
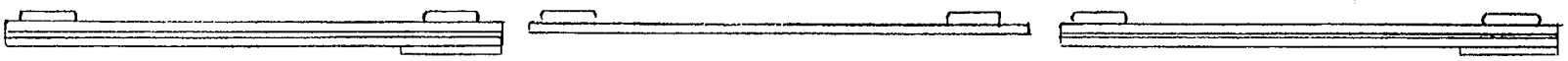
FIG. 4*c* is a side elevational view of the detachable compartment shown in FIG. 4*a;*

FIGS. 2*a* and 2*b* show the detailed configuration of the base 12, with only detachable pocket and/or display compartment 14 attached. As shown, the base 12 has a front surface 20 and a back surface 22. The front surface 20 has at least one engaging portion 24 of the pocket attachment means 18 fixedly attached thereto. In the preferred embodiment, the engaging portions 24 comprise a plurality of male portions of a plurality of snap fasteners attached in spaced-apart relation to the front surface 12. The spacing of engaging portions 24 is such that each group 21 consists of five engaging portions 24. These groups 21 are equally spaced apart on the base 12. Further, the spacing of the engaging portions 24 within a group 21 corresponds to the spacing of receiving portions 32 which are included on the pocket 14, more particularly described with reference to FIGS. 3*a*–4*c*. It is appreciated that the engaging portions 24 can be arranged in any suitable configuration and may be of any suitable number, to accommodate pockets varying in size, shape, and number. In addition, it is also appreciated that the engaging portions 24 may suitably be replaced with receiving portions 32 of the pocket attachment means 18 so long as the receiving portions 32, included on the pocket 14, are replaced with engaging portions 24 to provide an appropriate counterpart.

As more clearly indicated in FIG. 2*b*, the back surface 22 of base 12 has the base attachment means 16, 17, 44, and 46 fixedly attached thereto. The base attachment means 16, 17, 44, and 46 of the preferred embodiment comprises suitably arranged magnetic strips for facilitating a magnetic connection to a refrigerator door, appliances, sheet metal or other ferrous metal which can be covered with an enamel surface or the like or any other ferromagnetic or paramagnetic surface disposed in a generally vertical plane. In the embodiment of the invention shown in FIG. 2*b*, base attachment means, or magnet element, 17 is positioned horizontally along the upper edge 15 of base 12, and base attachment means, or magnet element, 16 is positioned horizontally along the bottom edge 13 of base 12. Likewise, base attachment means, or magnet elements, 44 and 46 are positioned vertically along side edges 48 and 50, respectively. In the preferred embodiment, the magnet elements 16, 17, 44, and 46 are fixed to the back surface 22 by means of an adhesive or other known fixing means. It is recognized that one skilled in the art could conceive other equivalent base attachment means and/or the positioning of the base attachment means without altering the scope of the invention. For example, one or more adhesive coated double-sided tapes, etc. could be horizontally, vertically, etc. suitably utilized. Additionally, in the absence of a metallic vertical surface, reinforced holes could suitably be disposed along upper edge 15 to allow the holding apparatus 10 to be hanged on hooks or the like.

FIGS. 3*a* through 4*c* show a detailed configuration of one of the storage and/or display compartments 14. The pockets can be of varying sizes and shapes. As shown in FIGS. 3*a* through 4*c*, pocket 14 includes a front portion 26 and a back portion 28. The front portion 26 and the back portion 28 are joined, preferably heat sealed, along the side and bottom edges to form sealed points 29. The sealed points 29, the front portion 26 and the back portion 28 create an inner compartment 27 which make up pocket 14. However, as it is understood in the art, alternative joining means, such as adhesive glue, etc. may also be utilized to produce the storage and/or display pocket 14 having an inner compartment 27. Similarly, pocket 14 may also be compound of a single sheet folded transversely at its center and joined at the sides. Furthermore, the invention also encompasses storage and/or display compartments which do not require joined front portion 26 and back portion 28. In an alternative embodiment, only a back portion 28 is utilized with the compartment or pocket attachment means 18 and the base 12 to form the storage and/or display compartment 14.

As demonstrated in FIGS. 3*a*–4*c*, the front portion 26 of the pocket 14 may also include a notch 30. The notch 30 is provided with a protective plastic or metal strip guard 42 which prevents tearing of the pocket 14 and accommodates simple access to the inside of the pocket 14, i.e., access to inner compartment 27. When the pocket 14 includes a front portion 26 and a back portion 28, the back portion 28 of the pocket 14 has at least one receiving portion 32 of the pocket attachment means 18 (shown in FIGS. 4*a*–4*c* and shown in phantom in FIG. 3*b*) fixedly attached thereto. In the preferred embodiment, the receiving portions 32 comprise a plurality of female portions of a plurality of snap fasteners attached to the back portion 28 in spaced-apart relation. The spacing of the receiving portions 32 corresponds to the spacing of the male portions, or engaging portions 24, fixedly attached to the base 12. More particularly, the receiving portions 32 are arranged in corresponding relation to the notch 30 and each corner of the pocket 14. The receiving portion 32 corresponding to the notch 30 allows for further simple access to the inner space 27. Pocket 14 is utilized as an example. However, it is appreciated by the inventor that the configuration of the receiving portions 32 will vary with respect to the size and shape of the pocket. For instance, a different configuration of receiving portions 32 is required for pocket 31 than for pocket 14.

In the embodiment of the invention wherein pocket 14 only comprises of a back portion 28 (see FIGS. 4*a*–4*c*), the back side of back portion 28 has a plurality of receiving portions 32 of the pocket attachment means 18 fixedly attached thereto. As in the embodiment of the invention comprising a pocket 14 having a front portion 26 and a back portion 28, the spacing of receiving portion 32 corresponds to the spacing of the engaging portion 24, fixedly attached to the base 12.

The preferred embodiments result in a holding apparatus 10 which can be attached to a generally vertical surface such as a refrigerator door simply by engaging the base attachment means 16, 17, 44, and 46 to the door, resulting in a magnetic connection between the two. The holding apparatus will remain in fixed contact to the vertical surface until finally removed therefrom. In addition, the magnetic attachment means will not harm or damage the vertical surface while the holding apparatus 10 is attached. Further, the holding and/or display apparatus 10 can be easily removed in order to facilitate cleaning, painting, etc. Once attached to the door, the holding apparatus 10 functions as a convenient location for storing and organizing small, thin objects such as business cards, coupons, appointment cards . . . etc. Each of these types of objects can be stored in a separate pocket 14. The pocket 14 can then be removed for use, replacement, etc. For example, a pocket 14 containing coupons can be removed from the holding apparatus 10 by detaching the pocket 14 through use of the pocket attachment means 18, directly placed in a purse, handbag, coat pocket, or the like, and carried to a retail store. This feature obviates the need to remove the objects from the pocket 14. The objects are also protected from loss or destruction.

Another advantageous feature of the holding apparatus 10 in the preferred embodiment is that it is constructed of transparent plastic. This lends itself not only to aesthetics but also convenience. The clear plastic allows the contents of the pocket to be viewed from the outside. So, for example, a dental appointment card can be placed in the pocket 14. As such, the appointment card can be conveniently viewed from anywhere in the line of sight of the holding apparatus 10. This not only serves as a constant reminder to the user of the appointment but also reduces the gravity of unfortunate circumstances surrounding the loss of appointment cards or the like.

Figure 5:
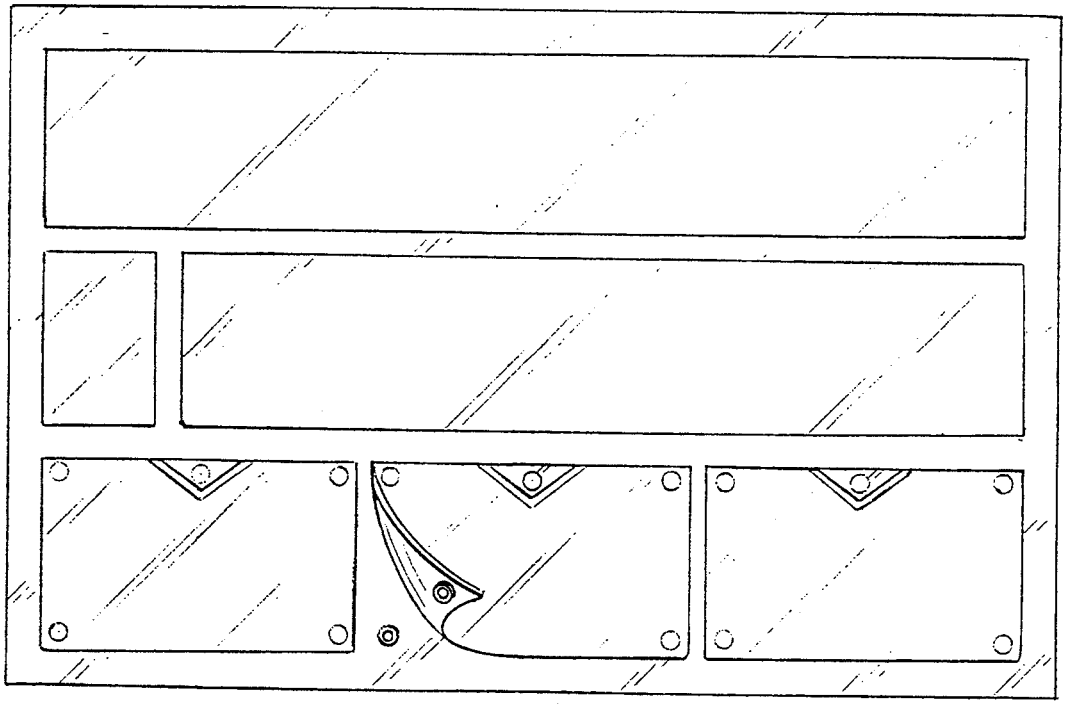
FIG. 5 is a front elevational view of an alternative embodiment of the present invention; and, FIG. 6 is a front elevational view of a further alternative embodiment of the present invention.

FIG. 5 shows an alternative embodiment of the holding apparatus 10. As shown, the base 12 includes two distinct areas, first area 34 and second area 36, disposed on the front surface 20 of the base 12. It is appreciated that the first area 34 and the second area 36 can be configured in various patterns, not being limited to the configuration shown. The first area 34 has a first set of pockets 38 fixedly attached thereto. In the preferred embodiment, the sides and bottom edges of the first set of pockets 38 are sealed to the base 12 by heat sealing, although it is recognized that other suitable methods of permanent attachment can be used. The second area 36 has engaging portions 24 fixedly attached thereto for engaging corresponding receiving portions 32 of a second set of pockets 40. Each of the pockets 40 are substantially similar to the pocket 14 of the preferred embodiment. The number and configuration of pockets 40 will vary in this alternative embodiment of the invention.

In addition, the alternative embodiment of the invention shown in FIG. 5 functions substantially similarly to the embodiment of the invention set forth in FIGS. 1–4. The only difference being that the pockets 38 cannot be removed from the holding apparatus 10 as they are heat sealed to the base 12.

Even though the pocket attachment means 18 is described as being a snap fastener mechanism in the embodiments of the invention described above, it is appreciated by the inventor that other suitable fastener methods could be utilized to achieve substantially the same result. For instance, hook and loop fastening strips such as VELCRO ® strips could be used as a substitute. In that case, the hook side of the strips could function as the engaging portions 24 and the loop side could function as the receiving portions 32, or vice versa. Obviously, the hook strips would be appropriately arranged on the front surface 20 in the first embodiment or on the second area 36 in the second embodiment. The loop strips would be appropriately arranged on the back portion 28 of each of the plurality of pockets 14 or the second set of pockets 40, respectively.

Figure 6:
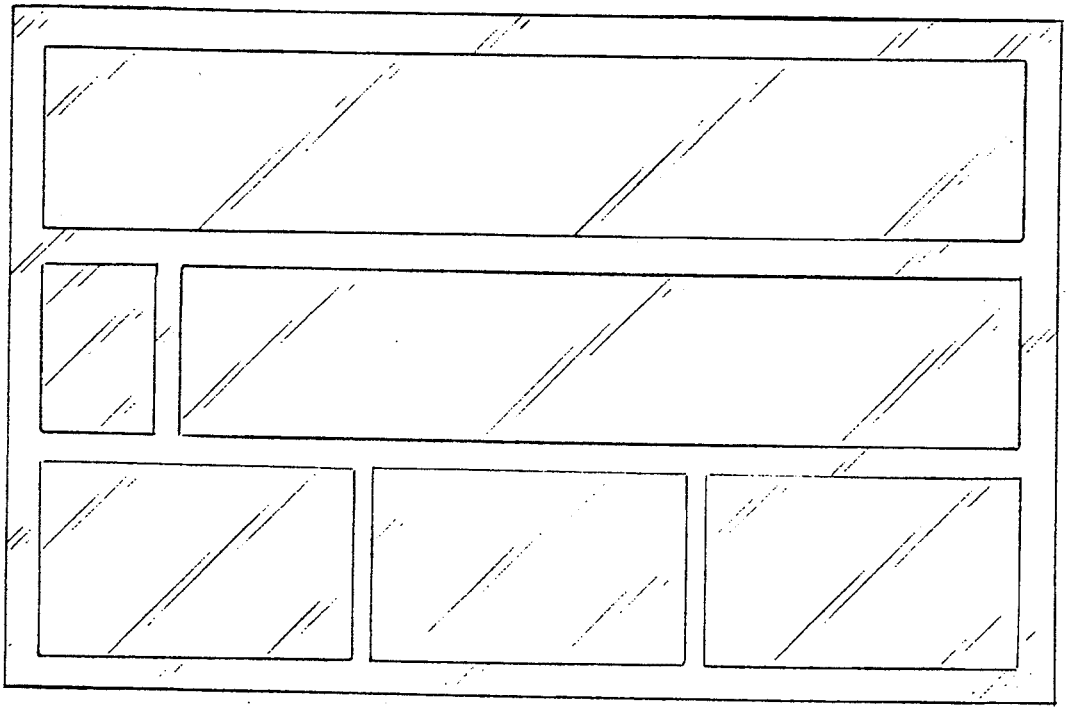

A further embodiment of the invention shown in FIG. 6 is similar to the embodiment of the invention disclosed in FIG. 5 with the exception that all of the pockets utilized in the device are comprised of pockets 38 as opposed to pockets 40. However, since all of the pockets 38 cannot be removed from the holding apparatus 10 as they are heat sealed to the base 12, this embodiment of the invention is less preferred to the embodiments of the invention set forth in FIGS. 1–4 and FIG. 5.

The above description merely provides a disclosure of particular embodiments of the invention and is not intended for the purpose of limiting the same thereto. As such, the invention is not limited to only the above described embodiments. Rather, it is recognized that one skilled in the art could conceive alternative embodiments that fall within the scope of the invention.

Having thus described the invention, I claim:

1. A holding apparatus comprising:

a generally thin planar flexible base having front and back opposed surface;

at least one magnetic strip for attaching the base to a surface disposed in a generally vertical plane, the magnetic strip being generally thin and fixedly attached to the back surface of the base;

at least one generally thin transparent plastic compartment for holding or displaying objects, wherein said compartment is releasably attached to the front surface of said base and wherein said compartment has a front portion, a back portion, and an inner compartmental space having an opening formed by said front and back portions for receiving objects;

a notch formed in the front portion along the opening and provided with a protective strip; and, compartment attachment means for releasably attaching the compartment to the front surface of the base, the compartment attachment means including at least one engaging portion and at least one corresponding receiving portion, and wherein the engaging portion is fixedly attached to the front surface of the base and the receiving portion is fixedly attached to the back portion of the compartment in corresponding relation to the notch.

2. The holding apparatus of claim 1 wherein the base is formed of lightweight transparent plastic.

3. The holding apparatus of claim 1 wherein the compartment attachment means comprises a plurality of snap fasteners.

4. The holding apparatus of claim 1 wherein the compartment attachment means comprises a plurality of hook and loop fasteners.

5. A holding apparatus comprising:

a generally thin planar flexible base having front and back opposed surface;

at least one magnetic strip for attaching the base to a surface disposed in a generally vertical plane, the magnetic strip being generally thin and fixedly attached to the back surface of the base;

at least one generally thin transparent plastic compartment for holding or displaying objects, wherein said compartment is releasably attached to the front surface of said base and wherein said compartment has a front portion, a back portion, and an inner compartmental space having an opening formed by said front and back portions for receiving objects;

a notch formed in the front portion along the opening and provided with a protective strip; and compartment attachment means for releasably attaching the compartment to the front surface of the base, the compartment attachment means including at least one receiving portion and at least one corresponding engaging portion, and wherein the receiving portion is fixedly attached to the front surface of the base and the engaging portion is fixedly attached to the back portion of the compartment in corresponding relation to the notch.

6. The holding apparatus of claim 5 wherein the base is formed of lightweight transparent plastic.

7. The holding apparatus of claim 5 wherein the compartment attachment means comprises a plurality of snap fasteners.

8. The holding apparatus of claim 5 wherein the compartment attachment means comprises a plurality of hook and loop fasteners.

9. A holding apparatus comprising:

a generally thin planar flexible base having front and back opposed surfaces, the front surface including a first area and a second area;

at least one magnetic strip for attaching the base to a surface disposed in a generally vertical plane, the magnetic strip being generally thin and fixedly connected to the back surface of the base;

at least one generally thin transparent plastic first compartment for holding or displaying objects, wherein the first compartment is fixedly connected to the first area of the front surface of the base;

at least one generally thin transparent plastic second compartment for holding or displaying objects, wherein the second compartment is releasably attached to the second area and wherein the second compartment has opposed front and back portions and an inner compartmental space having an opening formed by said front and back portions for receiving objects;

a notch formed in the front portion along the opening and provided with a protective strip and, compartment attachment means for releasably attaching the second compartment to the second area of the front surface of the base, the compartment attachment means including at least one engaging portion and at least one corresponding receiving portion, wherein the engaging portion is fixedly attached to the second area of the front surface of the base and the receiving portion is fixedly attached to the back portion of the second compartment in corresponding relation to the notch.

10. The holding apparatus of claim 9 wherein the base is formed of lightweight transparent plastic.

11. The holding apparatus of claim 9 wherein the compartment attachment means comprises a plurality of snap fasteners.

12. The holding apparatus of claim 9 wherein the compartment attachment means comprises a plurality of hook and loop fasteners.

13. A holding apparatus comprising:

a generally thin planar flexible base having front and back opposed surfaces, the front surface including a first area and a second area;

at least one magnetic strip for attaching the base to a surface disposed in a generally vertical plane, the magnetic strip being generally thin and fixedly connected to the back surface of the base;

at least one generally thin transparent plastic first compartment for holding or displaying objects, wherein the first compartment is fixedly connected to the first area of the front surface of the base;

at least one generally transparent plastic second compartment for holding or displaying objects, wherein the second compartment is releasably attached to the second area and wherein the second compartment has opposed front and back portions and an inner compartmental space having an opening formed by said front and back portions for receiving objects;

a notch formed in the front portion along the opening and provided with a protective strip; and, compartment attachment means for releasably attaching the second compartment to the second area of the front surface of the base, the compartment attachment means including at least one receiving portion and at least one corresponding engaging portion, wherein the receiving portion is fixedly attached to the second area of the front surface of the base and the engaging portion is fixedly attached to the back portion of the second compartment in corresponding relation to the notch.

14. The holding apparatus of claim 13 wherein the base is formed of lightweight transparent plastic.

15. The holding apparatus of claim 13 wherein the compartment attachment means comprises a plurality of snap fasteners.

16. The holding apparatus of claim 13 wherein the compartment attachment means comprises a plurality of hook and loop fasteners.

* * * * *